United States Patent [19]

Maimann et al.

[11] Patent Number: 4,635,041

[45] Date of Patent: Jan. 6, 1987

[54] THEFT PROTECTION SYSTEM PARTICULARLY FOR SHOP AREAS

[75] Inventors: Mogens Maimann; Bent Svendsen, both of Roskilde, Denmark

[73] Assignee: 2 M Security Systems APS, Denmark

[21] Appl. No.: 690,497

[22] PCT Filed: Apr. 10, 1984

[86] PCT No.: PCT/DK84/00027

§ 371 Date: Dec. 11, 1984

§ 102(e) Date: Dec. 11, 1984

[87] PCT Pub. No.: WO84/04191

PCT Pub. Date: Oct. 25, 1984

[30] Foreign Application Priority Data

Apr. 12, 1983 [DK] Denmark ..... 1596/83

[51] Int. Cl.[4] ..... G08B 13/24

[52] U.S. Cl. ..... 340/572; 340/518; 340/551

[58] Field of Search ..... 340/572, 551, 518; 343/5 PD, 6.8 LC, 6.8 R

[56] References Cited

U.S. PATENT DOCUMENTS

| | | | |
|---|---|---|---|
| 3,256,517 | 6/1966 | Saltzberg et al. | 340/539 |
| 3,949,396 | 4/1976 | Cantrell | 343/5 R |
| 4,067,008 | 1/1978 | Sprowls et al. | 340/505 |
| 4,135,184 | 1/1979 | Pruzick | 340/572 |
| 4,257,038 | 3/1981 | Rounds et al. | 340/539 |
| 4,535,323 | 8/1985 | Eccleston | 340/572 |

*Primary Examiner*—Glen R. Swann, III

*Attorney, Agent, or Firm*—Banner, Birch, McKie & Beckett

[57] ABSTRACT

In a theft protection system, particularly for a shop area, several exit passages with individual antenna systems are surveyed by means of a single transmitter for the transmission of electromagnetic interrogation signals and a single receiver for reception of resonance signals generated by unauthorized removal of a good, the antenna system for all the exit passages being connected to the transmitter and the receiver through multiplexers. A central control unit controls the multiplexers so as to actuate the antenna systems in successive time frames, whereby only one antenna system is made operative at a time. With each exit passage is associated an alarm device which is only activated for an alarm release from an alarm-actuating circuit connected to the control unit in case of compliance with at least one positive and one negative alarm criterion.

6 Claims, 4 Drawing Figures

THEFT PROTECTION SYSTEM PARTICULARLY FOR SHOP AREAS

BACKGROUND OF THE INVENTION

The invention relates to a theft protection system, particularly for a shop area, for recording the unauthorized removal of objects or goods to which a preferably passive protection device is affixed having a resonance circuit tuned to a given frequency, through one of a number of exit passages, each of which comprises an antenna system having a transmitting antenna for transmitting electro-magnetic interrogation signals of said given frequency and a receiving antenna for the reasonance signals generated by the unauthorized removal of an object or a good through the passage, an alarm device being connected to a receiver connected with said receiving antenna to generate an alarm in response to reception of said resonance signal.

In recent years theft protection systems of this kind which are used mainly for theft protection of shops have gained increased use and are known in different designs, for instance with the arrangement mentioned above by which the recording of the unauthorized removal of a good from the shop area depends on detection of the electro-magnetic signal when the resonance circuit in a protection device affixed to the good, for instance, in the form of a disc, is influenced by the transmitted electro-magnetic interrogation signals.

In the known systems an antenna system with associated transmitter and receiver is required for each passage to be surveyed, whereby installation of a theft protection system for a shop area having several exit passages will be very expensive.

In addition, the known systems will in many cases not warrant sufficient security against false alarm from an antenna system caused by irrelevant signals such as electrical disturbances or signals from separate antenna systems in other exit passages in the vicinity.

From EPE-A-0003178 a system is known in which a number of exit passages are surveyed by means of separate transmitting/receiving devices controlled according to a master-slave principle and actuated in succeeding time frames.

SUMMARY OF THE INVENTION

For a theft protection system of the kind mentioned the above-mentioned shortcomings are remedied according to the invention in that the antenna systems for the exit passages are connected to a common transmitter and a common receiver through a transmitting multiplexer and a receiving multiplexer and that a common control unit is connected to and controls said multiplexers, said transmitter and said receiver for sequential coupling of said antenna systems to the transmitter and the receiver in successive time frames for individual ones of said exit passages and actuation of said transmitter and said receiver in a sequence of transmitting and receiving intervals within each time frame, said control device being further connected to a number of separate alarm generators for each of said exit passages for actuating an alarm generator associated with a given exit passage in response to compliance with at least one alarm criterion associated with the transmitting and receiving intervals associated with the exit passage.

By connecting a number of antenna systems for several exit passages to a single common transmitting-/receiving device with an associated control unit which may comprise a microprocessor, the installation costs for surveyance of several exit passages may be reduced considerably relative to the above-mentioned known systems. Thus, by the system according to the invention it is without difficulty possible to survey up to, for instance, thirty exit passages by means of a single transmitting/receiving device and a number of antenna systems and alarm devices corresponding to the number of passages, said antenna systems being actuated sequentially in succeeding time frames in the manner indicated.

Thereby, and through the distribution of the actuation of the individual antenna systems in time so that only one antenna system at a time is made operative, it is further made possible in an economic manageable way to use several alarm criteria for each exit passage, whereby a very high degree of certainty is obtained both for correct recording of actual unauthorized removal of a good at the actual exit passage and against false recording.

In order to obtain such an improved certainty a preferred embodiment of the system according to the invention is characterized in that after compliance with a first positive alarm criterion, viz reception of a resonance signal in a minimum number of successive receiving intervals within a time frame the transmitter and the receiver are locked to the antenna system of the relevant exit passage for a number of intervals beyond said time frame to examine a second positive alarm criterion.

BRIEF DESCRIPTION OF THE DRAWINGS

In the following the invention will be further explained with reference to the schematic drawings in which.

DESCRIPTION OF THE PREFERRED EMBODIMENTS

Figure 1:
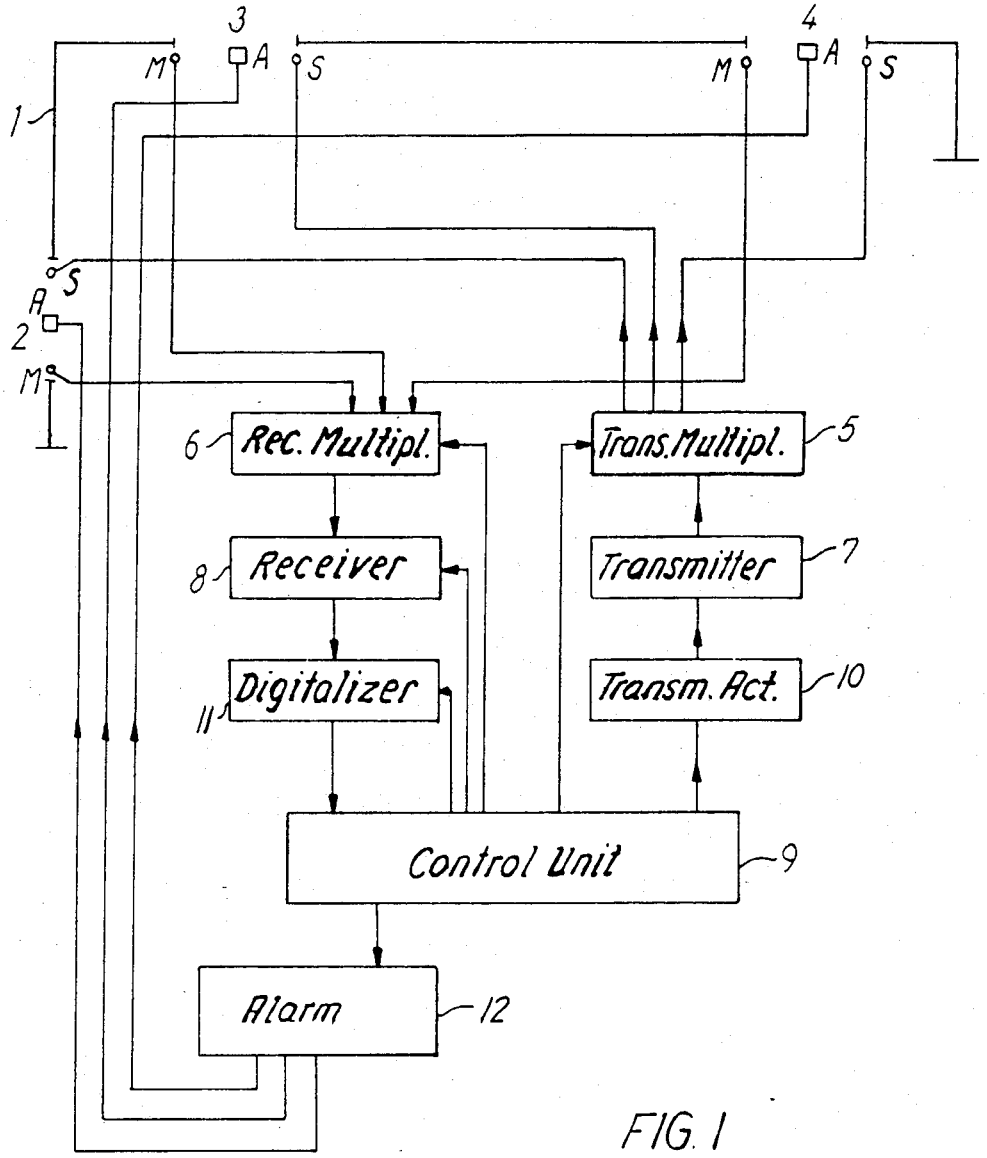
FIG. 1 is a block diagram of an embodiment of a theft protection system according to the invention.

In the embodiment of a theft protection system according to the invention shown in FIG. 1 a part of the border of a shop area is indicated symbolically at 1, said shop area having in this case three exit passages 2, 3 and 4 to be surveyed by means of the theft protection system.

At each of the exit passages 2, 3 and 4 an antenna system is provided which in this example comprises separate transmitting and receiving antennas S and M, respectively, as well as an alarm device A such as a lamp for generating a visual alarm signal. The transmitting and receiving antennas S and M may be of known design and need not necessarily be separate antennas, but may also be constituted by a single antenna device functioning both as a transmitting and a receiving antenna. In FIG. 1 the transmitting and receiving antennas S and M are shown to be arranged at either of the opposed vertical sides of the exit passages 2, 3 and 4, but they may also in a manner known per se be positioned in the floor and at the top of the exit passage.

In accordance with the invention the transmitting antennas S and receiving antennas M for all the exit passages 2, 3 and 4 are connected to a transmitting multiplexer 5 and a receiving multiplexer 6, respectively, connected on the other side to a transmitter 7 and a receiver 8, respectively, both of which are common to the antenna systems of all the exit passages 2, 3 and 4. A central control unit 9 which may comprise a microprocessor is connected to the transmitting multiplexer 5 and through a transmitter actuation circuit 10 to the transmitter 7 as well as to the receiving multiplexer 6 and the receiver 8 from which the control unit 9 receives the information signals, i.e. the resonance signal generated by unauthorized removal of a good with a protection device through one of the passages 2, 3 and 4, through a digitalization circuit 11. The control unit 9 is further connected to an alarm-actuating circuit 12 to which the alarm devices for the individual exit passages 2, 3 and 4 are connected.

Figure 2:
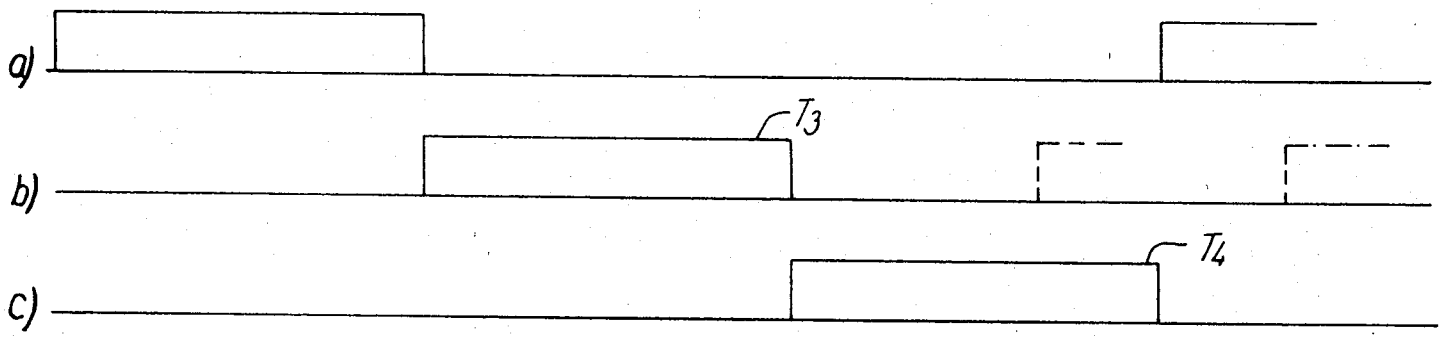
FIGS. 2*a*–2*c* and 3 are a time diagram and a signal diagram.

By means of the internal clock control of the control unit designed, for example, as a microprocessor the transmitting multiplexer 5 and the receiving multiplexer 6 are actuated for sequential coupling of the transmitting antennas S and the receiving antennas M at the exit passages 2, 3 and 4 to the transmitter 7 and the receiver 8 in succeeding time frames $T_2$, $T_3$ and $T_4$, such as shown at a, b and c in FIG. 2.

Figure 3:
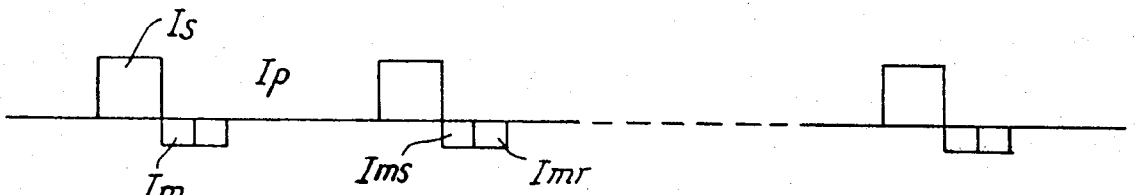

In the embodiment shown the transmitter activating circuit 10 is likewise controlled by means of the internal clock control of the control unit 9 such as shown in FIG. 3, so that in each of the time frames $T_2$–$T_4$ interrogation signal pulses are transmitted having a frequency of, for instance, 1 MHz in a number, e.g. 12, of transmitting intervals $I_s$, each of which may have a duration of, for example, 100 microsecs separated by intermediate longer pause intervals $I_p$ so as to provide a repetition frequency of, for example, 1.8 KHz for a transmitting interval corresponding to a duration of 6.66 millisecs for the time frames $T_2$–$T_4$.

In the pause intervals $I_p$ the receiver 8 is actuated from the control unit 9 immediately following each transmitting interval $I_s$ for reception of possible resonance signals caused by unauthorized removal of an object or a good through that of exit passages 2, 3 and 4, the antenna system of which is connected through the multiplexer 6 to the receiver 8 in a receiving interval $I_m$ shorter than the pause interval $I_p$ and of the same duration, for example, as the transmitting interval $I_s$. The remainder of the pause interval $I_p$ is utilized for control operations in the control unit 9 formed as a microprocessor.

Each of the receiving intervals $I_m$ is divided into two sub-intervals, e.g. a response interval $I_{ms}$ of such a duration that a correct resonance signal responding to an interrogation signal pulse in the preceding transmitting interval will fall within that interval and a reference interval $I_{mr}$ in which the receiver 8 is still kept open for the examination of disturbance signals for foreign response signals for use in the examination of the alarm criteria, the compliance with which according to the invention is a pre-condition for the generation of an alarm in order to provide certainty for the correct recording of the unauthorized removal of a good at the right exit passage as well as against false recording as a result of electrical disturbances or signals from other exit passages in the vicinity.

In order to provide such a high security there may in the embodiment shown be used two positive alarm criteria by which it is examined for a given exit passage whether resonance signals are actually received in a given minimum number of the receiving intervals within a time frame in response to the interrogation signal pulses in the preceding transmitting intervals and a negative criterion by which it is examined whether resonance signals are received without any transmission of interrogation signals at the relevant exit passage.

Thus, a preliminary first positive criterion may consist, for example, in that for a prescribed minimum number of successive receiving intervals $I_m$ a resonance signal should be received in the respective response interval $I_{ms}$ in response to the transmitting pulses in the preceding transmitting interval $I_s$.

Figure 4:
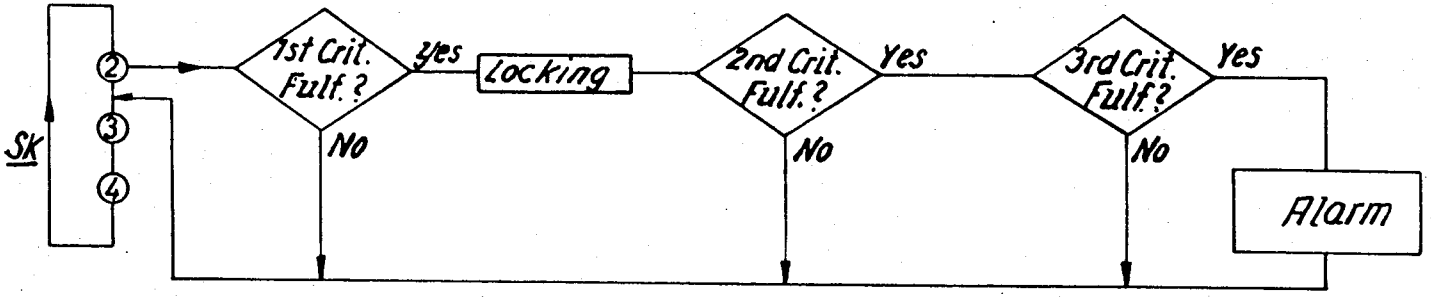
FIG. 4 is a flow chart to illustrate the operation of the system.

Thereby, the examination of this first criterion will be based on a simple counting operation in the control unit 9 concurrently with the reception of the response pulses and will be completed simultaneously with the termination of the relevant time frame. If the first criterion is not fulfilled, the next antenna system is switched on with a time frame $T_3$ by means of the multiplexers 5 and 6 such as illustrated by the scanning loop SK in FIG. 4.

On the other hand, if the first criterion is fulfilled, compliance with the second positive criterion is examined in that the receiver 8 is locked to the antenna system in question through the multiplexer 6 in a number of further transmitting and receiving intervals beyond the relevant time frame, for instance, in forty such intervals, and the second criterion may then consist in that resonance signals should also be received in a prescribed minimum number, for instance 12, successive ones of these further receiving intervals.

For each of the positive criteria the acceptance procedure may involve the requirement that a response signal may only be received in the respective reference interval $I_{mr}$ in a single one of said minimum number of receiving intervals.

If the second criterion is not fulfilled, a switching is now made to the next time frame $T_3$ since examination of the second criterion as illustrated in dashed lines in FIG. 2 entails a postponement of the initiation of the time frame $T_3$.

If also the second criterion is fulfilled, interruption of the transmitter 7 is effected by means of the actuating circuit 10 so that no interrogation signals are transmitted at the exit passage under examination for a number of further intervals of a duration equal to the sum of a transmitting interval $I_s$ and a succeeding pause interval $I_p$, for instance, sixteen such further intervals, and the third negative criterion now to be examined may consist in that a resonance signal may only be received in not more than one of these further intervals.

If the third criterion is not fulfilled, an error signal will be present and switching is now made to the succeeding time frame $T_3$ since the examination of the third criterion as shown by dot and dash lines at b in FIG. 2 entails a further postponement of the initiation of the following time frame.

On the other hand, if also the third criterion is fulfilled, the alarm-actuating circuit 12 is influenced to supply a signal to the alarm device A at the relevant exit passage, since by the compliance with all three criteria it is determined with a high degree of security that unauthorized removal of a marked good has occurred.

In connection with alarm-actuating the control unit 9 will in addition switch off the relevant antenna system so that scanning is continued only for the remaining antenna systems and the exit passages associated therewith until the alarm actuation, which may be of limited duration, has terminated.

We claim:

1. A theft protection system, particularly for a shopping area, for recording the unauthorized removal of objects to which a preferably passive protection device is affixed having a resonance circuit tuned to a given frequency, through one of a number of exit passages each of which comprises an antenna system having a transmitting antenna for transmitting electro-magnetic interrogation signals of said given frequency and a receiving antenna for the resonance signals generated by the unauthorized removal of an object bearing a said resonance circuit through the passage, an alarm device being connected to a receiver connected with said receiving antenna to generate an alarm in response to reception of said resonance signal, said antenna systems for the exit passages being connected to a common transmitter and a common receiver through a transmitting multiplexer and a receiving multiplexer, a common control unit is connected to and controls said multiplexers, said transmitter and said receiver for sequential coupling of said antenna systems to said transmitter and said receiver in successive time frames for individual ones of said exit passages and actuation of said transmitter and said receiver in a sequence of transmitting and receiving intervals within each time frame, said control device being further connected to a number of separate alarm generators, one for each of said exit passages for actuating an alarm generator associated with a given exit passage in response to compliance with at least one alarm criterion associated with the transmitting and receiving intervals associated with the exit passage.

2. A theft protection system as claimed in claim 1 wherein after compliance with a first positive alarm criterion, namely reception of a resonance signal in a minimum number of successive receiving intervals within a time frame, said transmitter and said receiver are locked to the antenna system of the relevant exit passage for a number of intervals beyond said time frame to examine a second positive alarm criterion.

3. A theft protection system as claimed in claim 2 wherein after compliance with said second alarm criterion said receiver is locked to the antenna system of the relevant exit passage for a still further number of intervals to examine a third, negative criterion, namely reception of a resonance signal in not more than a single one of said further intervals.

4. A theft protection system as claimed in claim 2 wherein in the examination of said positive alarm criteria each receiving interval is divided into a response interval and a succeeding reference interval and the positive criteria are conditional on reception of a response signal in said reference interval in only a single one of said minimum number of receiving intervals.

5. A system for detecting the presence of a control device of at least one of a plurality of locations, said system comprising:

receiving antenna means at each of said plurality of locations for receiving an interrogation signal and in response thereto generating an electromagnetic field at a predetermined frequency;

transmitter switching means coupled to each of said receiving antenna means for successively sending said interrogation signal to each respective receiving antenna means;

transmitter means coupled to said transmitter switching means for providing said interrogation signal;

transmitting antenna means at each of said plurality of locations for transmitting a response signal from said control device when said control device is within the electromagnetic field generated by said receiving antenna means;

receiver switching means having a plurality of inputs coupled to respective said transmitting antenna means for receiving signals from said transmitting antenna means and passing selected ones of said signals to an output;

receiver means coupled to said output of said receiver switching means for receiving the signals selected by said receiver switching means;

alarm means at each of said plurality of locations for indicating when said control device is at a respective location;

control means coupled to said receiver means, said receiver switching means, said transmitter means, said transmitting switching means and said alarm means for controlling the operation of said system, wherein said control means controls said transmitter switching means and said receiver switching means to successively connect each of said transmitting antenna means to said receiver means and its associated receiving antenna means to said transmitter means such that when said control device is within the electromagnetic field generated by one of said receiving antenna means, a responsive signal is received by said receiver from the associated transmitting antenna means, said responsive signal causing said control means to activate the associated said alarm means.

6. The system of claim 5 wherein said control device contains a resonant electrical circuit tuned to resonant at the frequency of said interrogation signal.

* * * * *